US006385885B1

(12) United States Patent
Valiulis

(10) Patent No.: US 6,385,885 B1
(45) **Date of Patent: *May 14, 2002**

(54) MARKETING DISPLAYS PROVIDING READY REPLACEABILITY OF ADHESIVE DISPLAY LABELS

(75) Inventor: Thomas E. Valiulis, Rockford, IL (US)

(73) Assignee: Southern Imperial, Inc., Rockford, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/754,245

(22) Filed: Nov. 20, 1996

(51) Int. Cl.[7] ..... G09F 3/00

(52) U.S. Cl. ..... 40/642.01; 40/638; 40/661.03; 40/661.09; 283/81

(58) Field of Search ..... 40/638, 642.01, 40/661.03, 661.09, 594, 595; 283/81

(56) References Cited

U.S. PATENT DOCUMENTS

| | | | | | |
|---|---|---|---|---|---|
| 2,563,340 | A | * | 8/1951 | Kelly | 283/81 |
| 3,912,084 | A | | 10/1975 | Valiulis | |
| 4,250,642 | A | * | 2/1981 | Riehle | |
| 4,452,360 | A | | 6/1984 | Barnes | |
| 4,589,685 | A | * | 5/1986 | Lazar | 283/81 |
| 4,718,626 | A | * | 1/1988 | Thalenfeld et al. | 40/642.01 |
| 4,783,033 | A | | 11/1988 | Valiulis | |
| 4,787,159 | A | * | 11/1988 | Fast | 40/642.01 |
| 4,805,861 | A | * | 2/1989 | Thalenfeld et al. | 40/642.01 |
| 4,850,557 | A | | 7/1989 | Valiulis | |
| 4,882,868 | A | * | 11/1989 | Fast | 40/642.01 |
| 4,900,604 | A | * | 2/1990 | Martinez et al. | 40/594 X |
| 4,976,058 | A | | 12/1990 | Valiulis | 40/657 |
| 5,120,941 | A | * | 6/1992 | Reilley et al. | 283/81 X |
| 5,135,261 | A | * | 8/1992 | Cusack et al. | 40/641 X |
| 5,231,779 | A | | 8/1993 | Valiulis et al. | 40/649 |
| 5,236,163 | A | | 8/1993 | Valiulis | |
| 5,269,691 | A | * | 12/1993 | Waldman | 40/594 |
| 5,299,834 | A | * | 4/1994 | Kraige | 283/81 X |
| 5,325,616 | A | | 7/1994 | Valiulis | 40/299 |
| 5,343,647 | A | * | 9/1994 | Bulka | 40/638 X |
| 5,369,125 | A | * | 11/1994 | Garrison | 283/81 |
| 5,428,914 | A | * | 7/1995 | Whitehouse et al. | 40/594 X |
| 5,464,681 | A | * | 11/1995 | Luce | 40/594 X |
| 5,597,634 | A | * | 1/1997 | Bloomer et al. | 428/40.1 |
| 5,628,858 | A | * | 5/1997 | Petrou | 40/594 X |
| 5,704,650 | A | * | 1/1998 | Laurash et al. | 283/81 |
| 6,145,231 | A | * | 11/2000 | Valiulis | 40/661.03 |

FOREIGN PATENT DOCUMENTS

| | | | | |
|---|---|---|---|---|
| DE | 3307694 | * | 9/1984 | 40/594 |

* cited by examiner

*Primary Examiner*—B. Dayoan
*Assistant Examiner*—Andrea Chop
(74) *Attorney, Agent, or Firm*—Leydig, Voit & Mayer, Ltd.

(57) ABSTRACT

A marketing display device such as a shelf or a "Pegboard" type hanger is provided with an outer display panel that has a Release coating, such as of silicone, for ready attachment, removal and replacement of adhesive labels that carry indicia pertinent to the marketing of products on the hangers to passing potential customers.

37 Claims, 6 Drawing Sheets

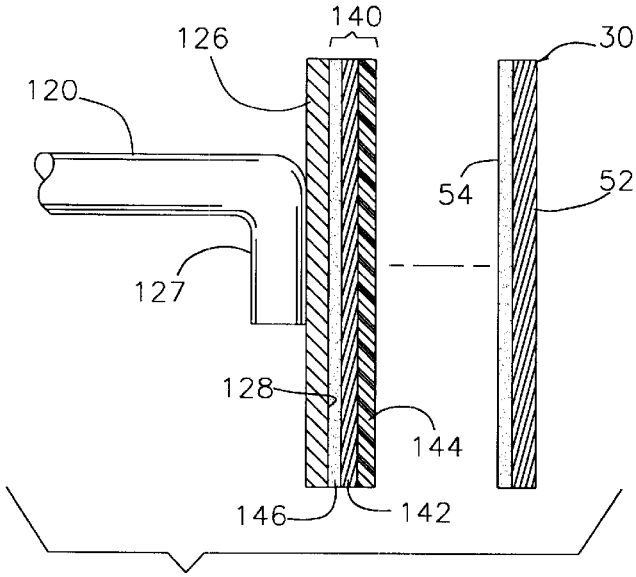
Fig. 10
Fig. 11
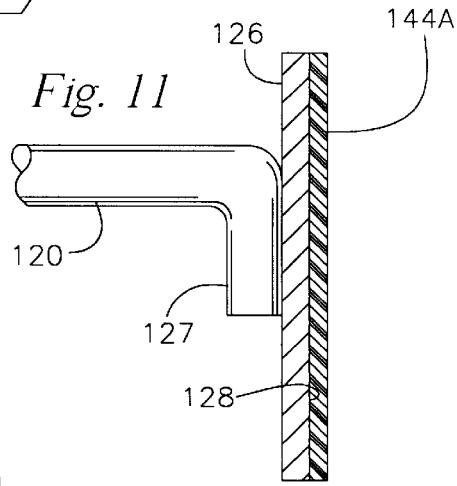
Fig. 13
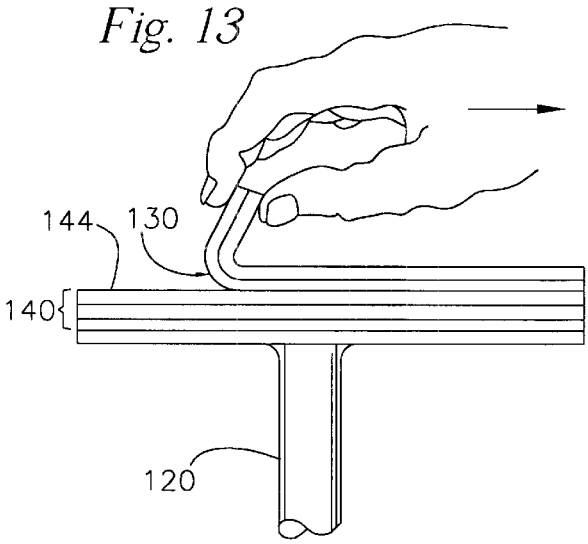
Fig. 12
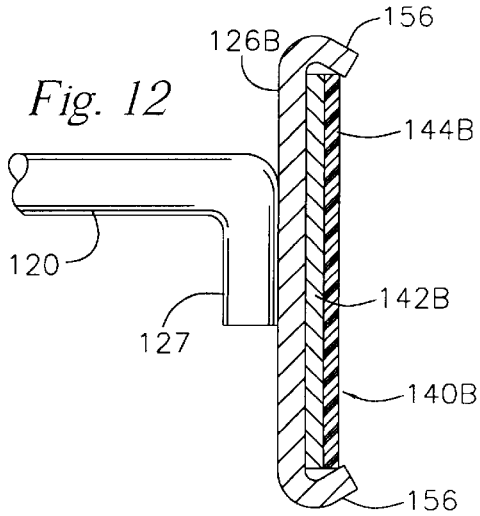

MARKETING DISPLAYS PROVIDING READY REPLACEABILITY OF ADHESIVE DISPLAY LABELS

RELATED APPLICATION

The disclosure of the application entitled Merchandise Hangers Providing Ready Replaceability of Adhesive Display Labels filed concurrently herewith is incorporated herein by reference.

FIELD OF THE INVENTION

This invention relates to marketing displays, such as merchandise hangers, shelving and racks.

BACKGROUND OF THE INVENTION

As is well known, a variety of hangers, shelving, racks and similar merchandise supports are used to support and display merchandise for convenient viewing and access by customers. A label support usually is provided on each merchandise support for supporting and prominently exhibiting a label or "tag" that may contain pricing, stockkeeping units and other information and indicia pertaining to the merchandise that is on display.

In such merchandise displays, it is desirable to permit ready application, removal and exchange of information labels, e.g. as in instances of changing of the products, prices, sale announcements, images which facilitate inventorying, and other pertinent information.

OBJECTS AND SUMMARY OF THE INVENTION

The general aim of the present invention is to provide marketing displays with improved label holder arrangements that permit easy removal and replacement of adhesive labels on such displays.

A more specific object of the invention is to provide such displays and related labels which assure smooth attractive affixation of each adhesive label while also providing simple, quick and economical removal and replacement as well as exchange of the labels as marketing circumstances and product information change.

These and other objects and advantages of the invention will become more apparent from the following description and the accompanying drawings.

Marketing display supports, which are designed for supporting products for selection and purchase by customers as those customers pass the supported products, are provided with a label supporting panel surface that includes an outer release layer. That release layer provides readily releasable adherent support for adhesive labels which display product information. More specifically, the release layer, which may be a thin coating of a silicone or similar material, adherently retains and supports an adhesively coated label that is pressed onto that surface and will readily release such a label, i.e. will permit the label to be peeled off cleanly with little effort, normally without tearing or splitting the label or leaving any residue therefrom on the label panel surface. Thereby labels applied to the label panel are exposed outwardly relative to the support for viewing by customers who pass by the display. The labels also are readily removable and replaceable, as well as exchangeable, by merchandising personnel as the facts and circumstances to be displayed change from time to time.

In the preferred embodiments, the release layer is affixed to the label support. One such embodiment utilizes a thin flexible liner or carrier member. This member includes a carrier body layer such as of paper or a synthetic base stock and is adhered to the support surface of the label support panel in a relatively permanent manner. The release layer is provided on the opposite side of the carrier body and thereby is exposed outwardly. In another preferred embodiment, the release layer is applied as a coating directly onto the label support panel. In each instance, adhesively backed labels are readily attached smoothly on the release layer and are readily and easily removable and replaceable manually by store personnel.

In other embodiments the label supporting panel may be provided with flanges, tabs or other lips or the like which serve as engagement elements to engage and retain a thin label carrier member. That carrier member includes a carrier body of a size, configuration and stiffness to engage within the engagement elements for retention thereby. A release layer is provided on the surface of the label carrier member which is disposed outwardly to releasably support adhesive labels thereon in the same manner as noted above.

BRIEF DESCRIPTION OF THE DRAWINGS

FIG. 10 is an enlarged somewhat schematic partial vertical sectional view taken generally at line 10—10 of FIG. 8 with the label in a detached position.

FIG. 11 is a sectional view similar to FIG. 8 and showing another embodiment employing teachings of this invention.

FIG. 12 is a sectional view similar to FIG. 10 and showing another embodiment employing teachings of this invention.

FIG. 13 is a top view which schematically illustrates the "peeling" removal of a label from the hanger assembly of FIG. 8.

Figure 1:
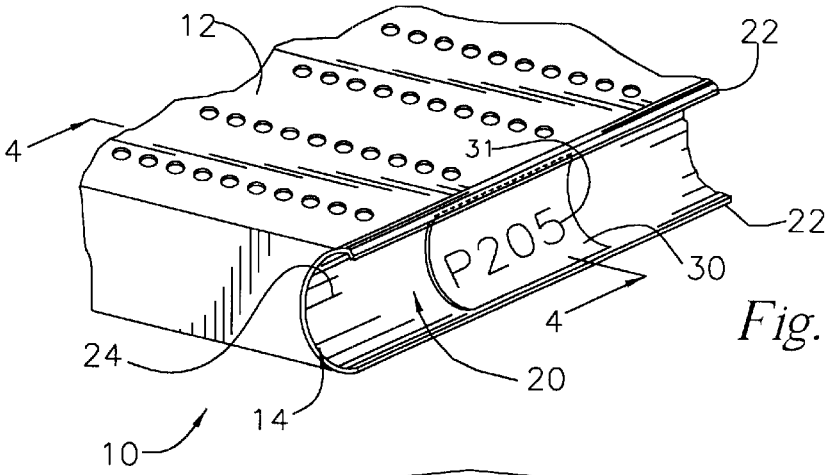
FIG. 1 is a perspective view of a typical marketing display shelf with a label support rail, which employs teachings of the present invention.

The thickness of various layers of materials and coatings are exaggerated in the various drawing figures for convenience and clarity of illustration.

While the invention is susceptible to various modifications and alternative constructions, preferred embodiments have been shown in the drawings and will be described in detail. It will be understood, however, that there is no intention to limit the invention to the specific embodiments illustrated or described herein, but on the contrary the intention is to cover all modifications, alternative constructions and methods and equivalents falling within the spirit and scope of the invention.

DETAILED DESCRIPTION OF THE PREFERRED EMBODIMENT

Figure 4A:
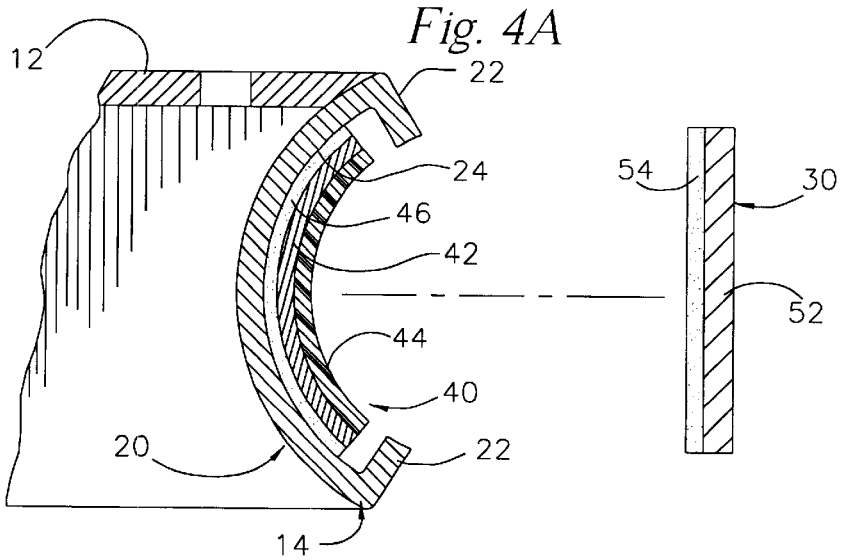
FIG. 4A is an enlarged somewhat schematic partial vertical sectional view taken generally at line 4—4 of FIG. 1 with a label in a detached position.

For purposes of illustration, one presently preferred embodiment of the invention is shown in the drawings in connection with a display support assembly 10. That assembly includes a shelf 12 with a conventional generally C-shaped "price channel" rail (PC Rail) 14 extending across the exposed outer edge of that shelf. Such a rail or other label panel may be affixed to the shelf as by welding or by the use of suitable fasteners or clips(not shown). Alternatively, the label panel may be a wall or surface of the basic support structure, for example an end wall or flange of the shelf such as is illustrated in FIGS. 4A and 5B. The rail or other label panel serves as a support for labels 30 or other display pieces which provide readable information to passing customers and/or to merchandising personnel concerning the merchandise to be sold from the support 10.

Figure 6:
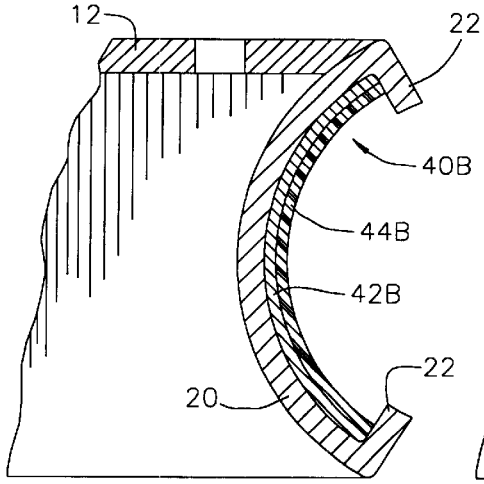
FIG. 6 is a sectional view similar to FIG. 4A and showing another embodiment employing teachings of this invention.

The rail 14 includes a generally C-shaped main body portion 20 with opposed flanges or lips 22 which extend the length of the rail at the opposite (upper and lower) edges of the C-shaped body 20. Each flange 22 is an integral extension from the body panel 21 and is disposed at an acute angle to the respective adjacent body portion. The flanges 22 may serve as guides for insertion and/or retention of removable label support elements and/or labels engaged within the rail 14, for example as seen in FIG. 6. The rail 14 includes a continuous outwardly exposed panel 24 of a shallow concave profile between the lips 22. Labels 30 are supported in the rail over this surface 24 for display purposes. The labels 30 are printed with indicia 31 such as the identification of the products on the support adjacent the respective label, or the price, stock number, inventory indicia or other information to be read by potential customers and/or merchandising personnel concerning that product/merchandise.

Figure 3:
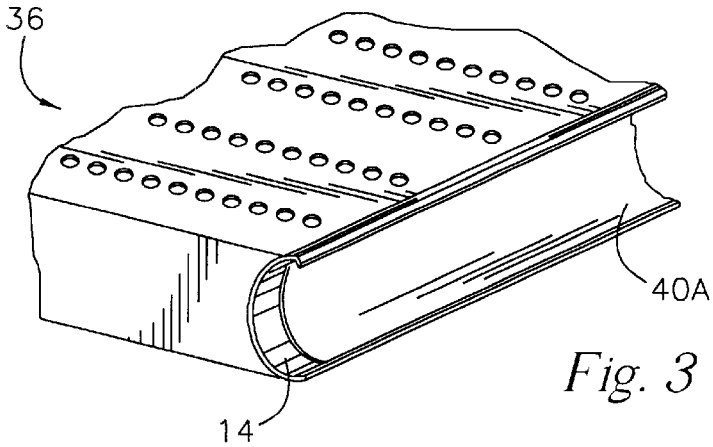
FIG. 3 is a perspective view similar to FIG. 1 and illustrating another embodiment employing teachings of this invention.

The support assembly 36 shown in FIG. 3 also comprises a support shelf and rail along the front edge of that support shelf, in the same manner as in the assembly of FIG. 1. The assembly of FIG. 3 differs from the assembly of FIG. 1 in that the embodiment illustrated in FIG. 1 contemplates applying short label holders randomly at various positions along the length of the rail, while the embodiment of FIG. 3 contemplates providing essentially the same form of label holding capabilities continuously along essentially the entire length of the rail, that is, across essentially the full width of the shelf.

Figure 4B:
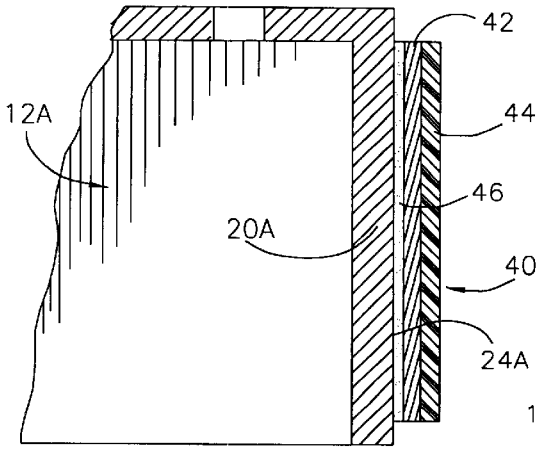
FIG. 4B is a view corresponding to FIG. 4A showing another embodiment employing teachings of this invention.

FIGS. 4–6 illustrate five embodiments for releasably and removably supporting display labels on an exposed surface of the shelf. Each embodiment presents a label support surface formed by a release coating 44, 44A, 44A', 44B to facilitate the removal and replacement of synthetic or paper adhesive labels. In each instance, when an adhesive label is applied to the release layer, the label will not slide or fall off. However, when it is desired to remove a label, that label may be peeled off with little effort, normally without tearing or delaminating the label and leaving no residue from the label on the support surface.

More particularly, in FIGS. 1–4B, a label release liner or carrier 40 includes a carrier body 42 with a release coating 44 on its outer side. A layer of adhesive 46 attaches the carrier 40 relatively permanently to the respective label support panel, e.g., to the surface 24 of the rail 14 of the shelf 12 or to the generally planar end panal surface 24A of the end flange 20A on the shelf 12A in FIG. 4B. In the illustrated preferred embodiment, the carrier body member 42 is a thin flexible sheet of paper or synthetic material which carries the adhesive layer or coating 46 on one side and the release coating or layer 44 on the opposite side. The release layer 44 preferably is a thin coating of a silicone resin or similar material which will retain a flexible adhesively backed label smoothly and uniformly on the label support plate without sliding or falling off.

Thereby, indicia 31 will be correctly and pleasingly presented to customers who are passing and have access to the merchandise on the shelves.

Figure 2:
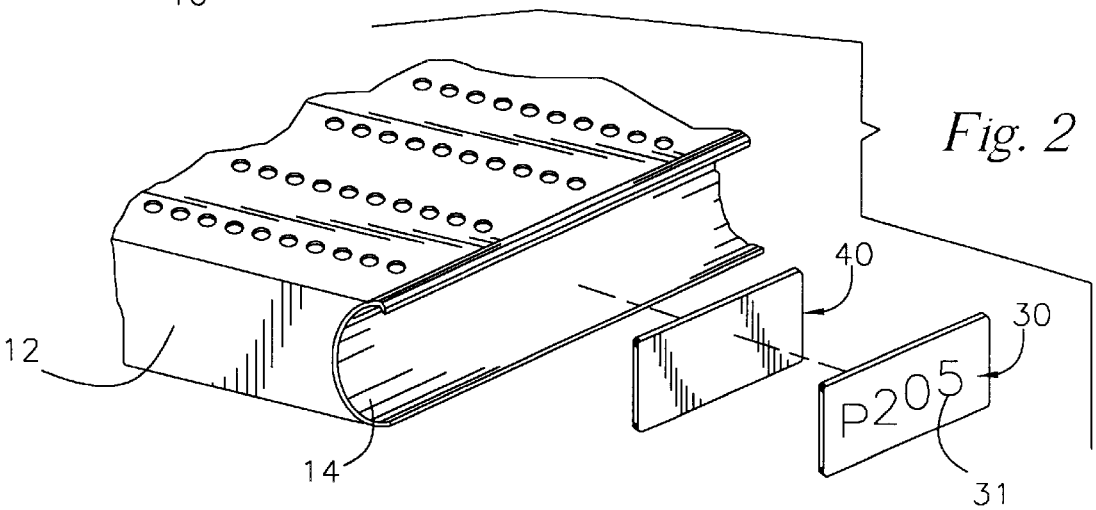
FIG. 2 is a perspective view of the support assembly of FIG. 1, with the label support liner and the label for placement thereon shown in exploded positions.
Figure 7:
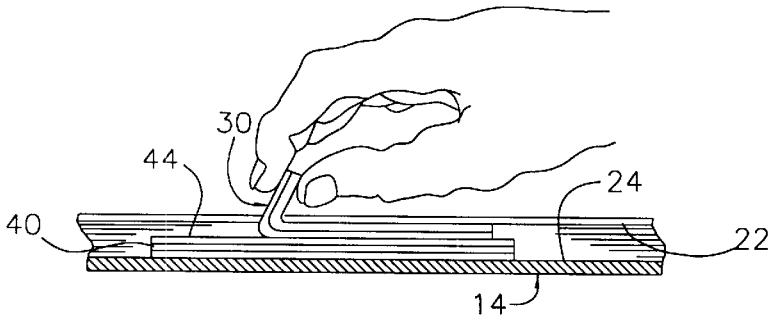
FIG. 7 is a top view which schematically illustrates the peeling removal of a label from the assembly of FIG. 1.

As indicated in FIG. 4A, the label 30 typically includes a paper or synthetic stock body 52 carrying an appropriate adhesive 54 on one side and indicia printed or otherwise displayed on the opposite side; see indicia 31 indicated in FIGS. 1 and 2. The release layer 44 permits a previously mounted label 30 to be removed by peeling it off cleanly, with little effort and without leaving residue of the label adhesive 54 or portions of the label body 52 on the surface of the layer 44. Such a removal typically comprises raising a corner or edge, as with a fingernail, and pulling outward on the label, i.e. peeling it off by pulling on the freed edge in a direction generally away from the surface and progressively back over the attached portion of that label surface 28 as illustrated generally in FIG. 7. A liner 40 with a release coating 44 may be applied to the rail surface 24 at any time, e.g., by the manufacturer of the supports, or by a distributor or by a customer prior to or after installing the supports at a display site.

Figure 5A:
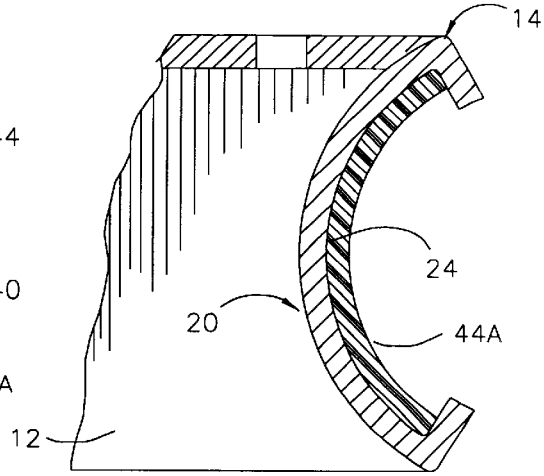
FIGS. 5A and 5B are sectional views similar to FIGS. 4A and 4B and showing other embodiments employing teachings of this invention.
Figure 5B:
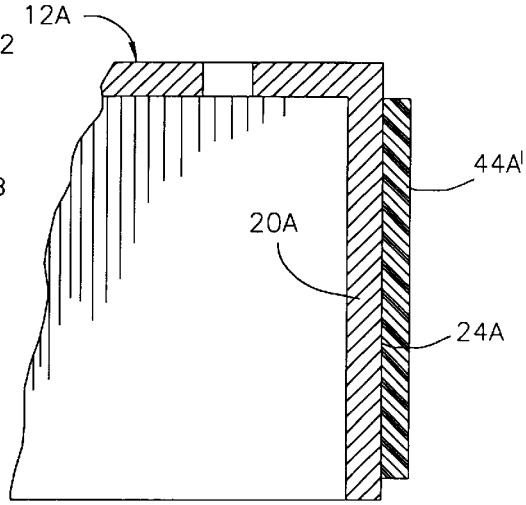

In the embodiments illustrated in FIGS. 5A and 5B, a release layer 44A, 44A' is applied as a coating directly on the respective label support panel, that is on the rail surface 24 in FIG. 5A and on the surface 24A of the end flange 20A of the shelf 12A in FIG. 5B. An adhesive label 30 is mountable on and removable from the front exposed surface layer 44A, 44A' in the same manner noted in respect to the embodiment of FIG. 3.

In the embodiment of FIG. 6, a carrier member 40B is provided which comprises a carrier body element 42B, such as of paper or synthetic material, with a release coating 44B on one side. The carrier member 40B serves somewhat similarly to the liner 40 of FIG. 3, except there is no adhesive layer on the inner side. The carrier member 40B is of an appropriate size and stiffness to be mounted by sliding or snap-in engagement between the pair of opposed lips 22 that are formed along the upper and lower edges of the rail 14. Thus the carrier member 40B is supported mechanically, as opposed to being adhered to the surface 24 as in FIG. 4. The outwardly exposed release layer 44B removably supports labels 30 in the same manner as described above.

The subject rails 14 may be formed of any suitable metal, synthetic plastic or similar material. The carrier body panel elements 42, 42B may be formed of paper stock or a synthetic material such as polyester, polyvinylchloride (PVC), polypropylene or polyurethane of suitable weight and stiffness or flexibility. One example is a 50" minimum bleached super calendar kraft (SCK) paper.

The adhesive 46 may be any adherent material that is compatible with the materials of the supports 20, 20A and the carrier panel body 42 and which provides adherent strength (bond tensile strength) between the rail surface 24, 24A and the panel body 42 that is substantially greater than the adherent strength of the bond between the release layer 44 and the adhesive 54. Examples of typical suitable adhesives 46 include rubber-based and acrylic adhesives, which may be pressure sensitive adhesives and may be the same as or different from the adhesive 54 of the labels 30. The release layer assures ready parting at the interface between the layer 44 and the adhesive 54 even if the adhesive 54 has the same or a higher bonding strength potential than the adhesive 46.

In each embodiment, the release layer or coating 44, 44A, 44A', 44B preferably is a silicone material, i.e., contains a silicone and appropriate amounts of controlled release additives (CRA resins), which releasably supports labels 30 that use typical pressure sensitive adhesive layers 54. However, the release layer 44 may be formed of any material which will similarly retain an adhesively applied label in place while also assuring a sufficiently low adherent strength of the bond between the adhesive 54 and the layer 44, 44A, 44A', 44B to permit the label to be easily and completely removed by peeling it from the support panel, normally as an integral element. It will be appreciated that this is a function of the tensile strength and tear resistance of the label as well as the adherence/release bonds between the label adhesive 54 and both the label body 52 and the release layer 44, 44A, 44' 44B. To these ends a silicone material which includes a moderate amount of CRA and that provides a release value less than two pounds, preferably less than about one pound, and particularly about 20–160 grams, for labels 30 adhered thereto by rubber-based or acrylic pressure sensitive adhesives such as are commonly used on present-day pressure sensitive labels, has been found satisfactory for the practice of this invention. Such a silicone material provides secure retention of the labels while assuring convenient integral removal of the labels by the attendant personnel when desired. Further, these results are attained when using ordinary paper labels, which are much less expensive than labels of synthetic materials, and even when using so-called "freezer grade" acrylic pressure sensitive adhesive for the adhesive layer 54. The latter adhesive is preferred for its higher and reliable adherent capabilities under adverse conditions.

One source of such a silicone material is Brown-Bridge Industries of Troy, Ohio. As used herein the term "release value" refers to the pulling force required to peel a 2" wide label from the release coating by pulling at 180° (parallel to the plane of the label, as illustrated generally in FIGS. 7 and 13) at 300"/min. by the standard Tag and Label Manufacturers Institute (TLMI) test method.

As indicated above, the label adhesive 54 typically is a pressure sensitive adhesive such as is commonly used on mailing labels and the like, e.g. rubber based or acrylic pressure sensitive adhesives. The adherent or tensile strength of the releasable bond between the release layer 44, 44A, 44A', 44B and the adhesive 54 is substantially less than the bond of the adhesive 54 to the label body 52, and also substantially less than the bonds of the adhesive 46 to the carrier body 42 and to the support plate 26. Further, this releasable bond is substantially less than the tensile strength and tear strength of the label body 52, even when the label body 52 is a common paper label, and less than the delamination strength of the carrier body 42.

Figure 8:
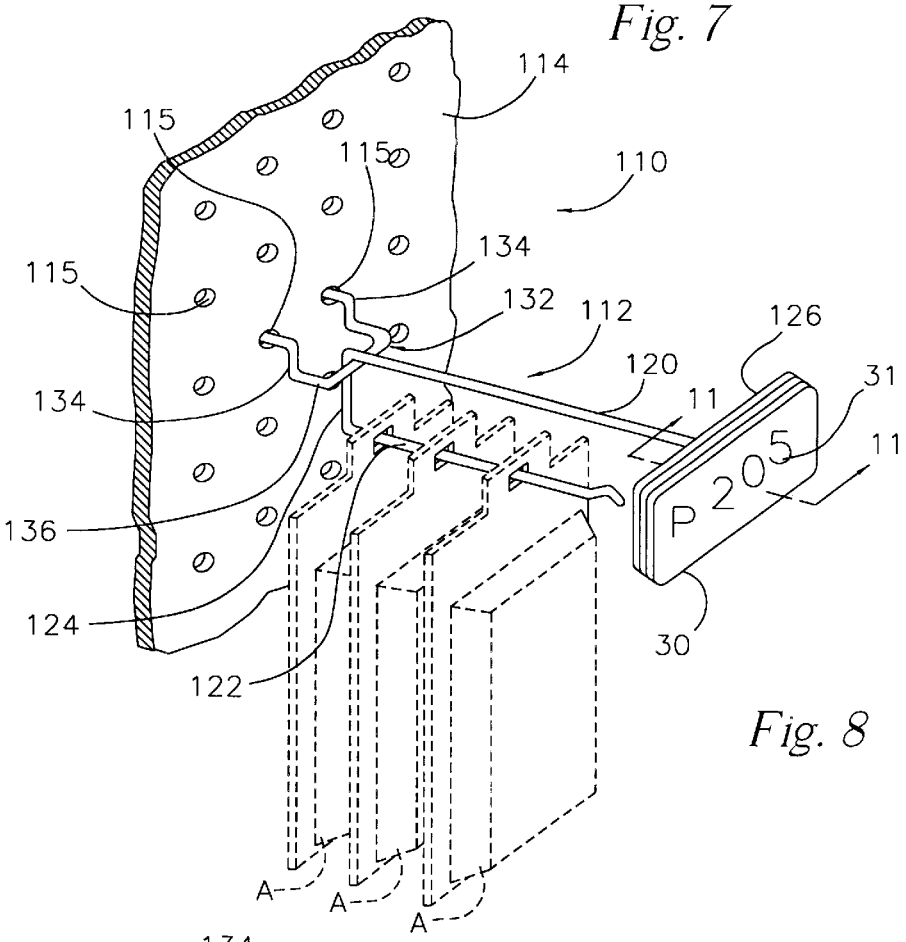
FIG. 8 is a perspective view of a typical display hanger assembly which employs teachings of the present invention, and illustrating a panel on which the hanger is mounted as well as merchandise supported on the hanger.
Figure 9:
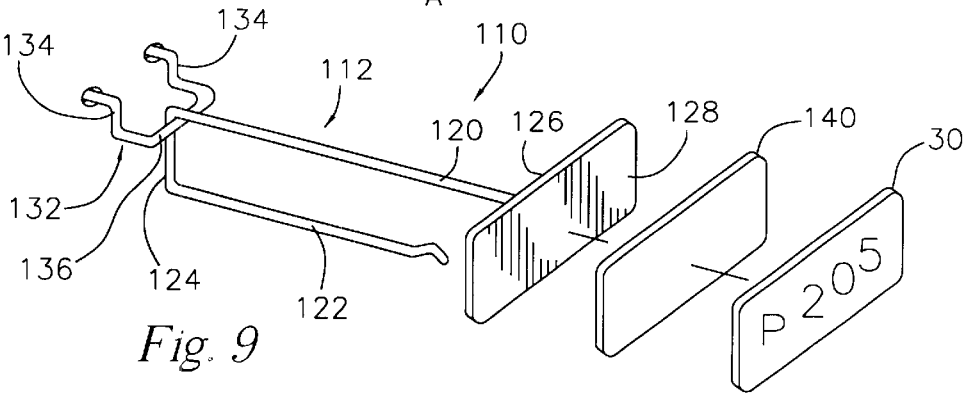
FIG. 9 is a perspective view of the hanger assembly of FIG. 8, with the label support liner and a label for placement thereon shown in exploded positions.

FIGS. 8–10 illustrate a preferred embodiment of the invention in connection with a hanger assembly 110. That assembly includes a product support hanger 112 for supporting one or more articles A from a panel or "Pegboard" 114 of the type formed with a series of vertically spaced and horizontally extending rows of holes 115. In this instance, the articles A are illustrated as bubble packages within which merchandise is contained. The upper end portion of each bag is formed with a hole to enable the bag to be hung from the hanger 112.

Herein, the product support hanger 112 is generally U-shaped and is made of a round rod or wire. The hanger includes upper and lower outwardly projecting generally horizontal arms 120 and 122 whose inner ends are formed integrally with and are joined by an upright connecting bight piece or connector portion 124. The lower arm 122 supports the articles A and often is referred to as the hanger arm. The upper arm 120 is often referred to as a scanner arm and carries a label support member 126 at its outer end. The illustrated support member 126 is a flat metal plate panel which is spot-welded to a vertical L-finger 127 on the inner end of the scanner arm 122; see FIGS. 10–12. However, the label support may have any of a variety of configurations and modes of attachment to the scanner arm; see for example the hangers described and illustrated in the U.S. Pat. Nos. 3,912,084, 4,452,360, 4,783,033, 4,850,557, 4,976,058, 5,231,779, 5,236,163 and 5,325,616 which are incorporated herein by reference. Such hangers may be formed of different diameter wire or rods, e.g., relatively small diameter wires for light duty and heavier arms made of larger diameter wire for heavy duty, or arms of other cross-sectional configurations.

The label support panel member 126 presents an outwardly exposed generally planar surface 128 for supporting labels or other displays of readable information to passing customers and/or to merchandising personnel concerning the merchandise to be sold from the hanger 112. To this end, the member 126, and specifically its outwardly exposed surface 128, extends generally orthogonally relative to the longitudinal axis of the arm 120. Labels 30 or other display pieces are supported on the surface 128.

The hanger assembly 110 further comprises a suitable mounting or engagement section 132 at its rear end for removably mounting the hanger 112 on the panel 114. The section 132 includes generally L-shaped fingers or horns 134 for extending through the holes 115 through a panel 114 in a hook-like fashion whereby engagement of the fingers 134 in the holes 115 and with the rear surface of the panel, along with the concurrent abutment of the lower portion of bight 124 with the front face of the panel, supports the hanger 112 in its generally horizontal position. In the illustrated bracket, the fingers 134 are opposite ends of a U-shaped mounting rod element 136 that is affixed at the upper inner portion of the bight 124, as by spot welding. However, it will be appreciated that the mounting arrangement for supporting the bracket 112 on a pegboard or similar support fixture may be of a wide variety of configurations.

FIGS. 8–13 illustrate three embodiments for releasably and removably supporting display labels on the inner surface of the label support plate 126, 126B in essentially the same manner as discussed above in reference to the embodiments 10 and 36 and particularly FIGS. 4–7. In FIG. 10, a liner 140 formed of a body 142 with adhesive 146 on one side and the release layer 144 on the opposite side is adhered to the support plate 126. In FIG. 11, a release coating layer 144A is applied and hereby directly bonded to the respective support plate 126. In FIG. 12, a carrier member comprising a body 142B and a release coating layer 144B is engaged between flanges 156 of the support plate member 126B. Thus, each embodiment presents a label support surface formed by a release coating 144, 144A, 144B to facilitate the removal and replacement of synthetic or preferably paper adhesive labels 30. These release coatings have the same characteristics and are of the same materials as the release coatings 44, 44A, 44A', and 44B discussed above.

Similar display members also may be used on other display supports, for example on fence-type shelving; see for example the abovecited U.S. Pat. No. 5,231,779. As illustrated in that patent, such shelving includes a plurality of laterally extending parallel rods whose outer ends are connected by a rod extending longitudinally along the front edge of the shelf. In such instances, as in the aforenoted L-shaped scanner arms, the merchandise support includes rods or wires extending at right angles to one another at the outer edge of the support and to which a display support with an outer release layer may be attached as in the aforedescribed embodiment.

The aforedescribed release coating material may be applied to the respective designated surface areas by spraying, brushing or other coating techniques, and may be applied to entire shelves 12, 12A or supports 126 by dip coating if desired.

Figure 14:
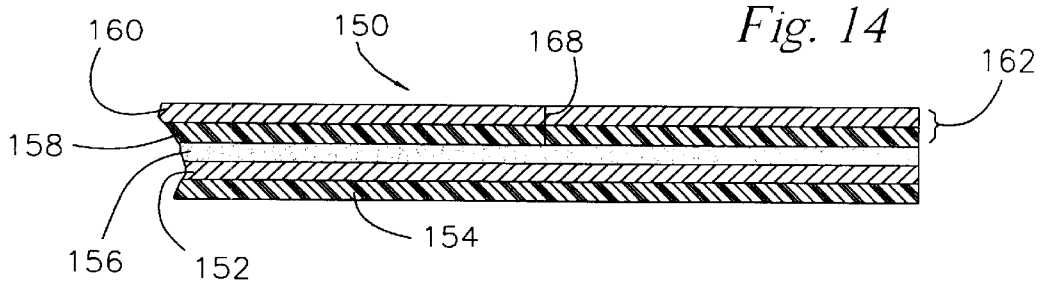
FIG. 14 is a cross-sectional view of label support liner stock as provided in sheet or strip form in accordance with teachings of this invention, e.g., an enlarged partial sectional view as taken along line 14—14 of FIG. 15.
Figure 15:
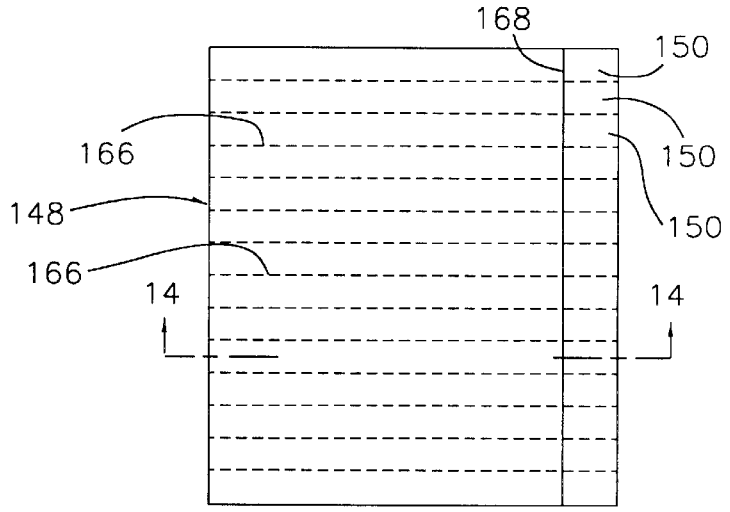
FIGS. 15 and 16 are plan views of two embodiments of multi-layer sheet stock material for providing a multiplicity of label support liners in accordance with teachings of this invention.
Figure 16:
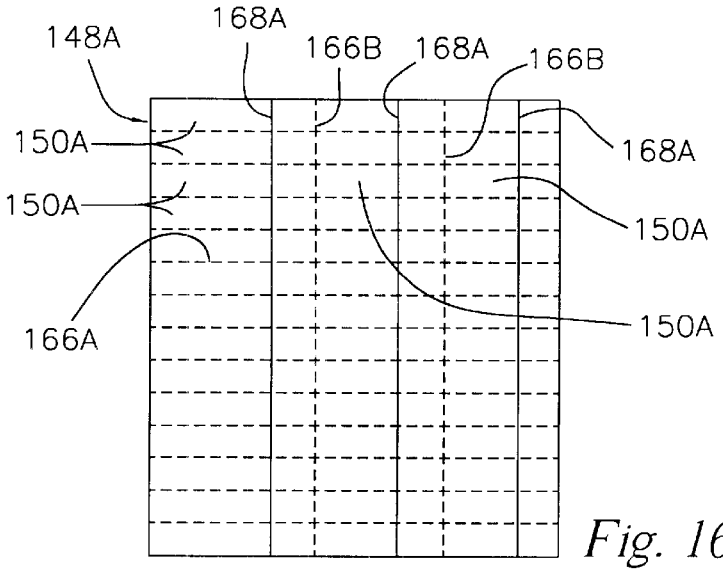
Figure 18:
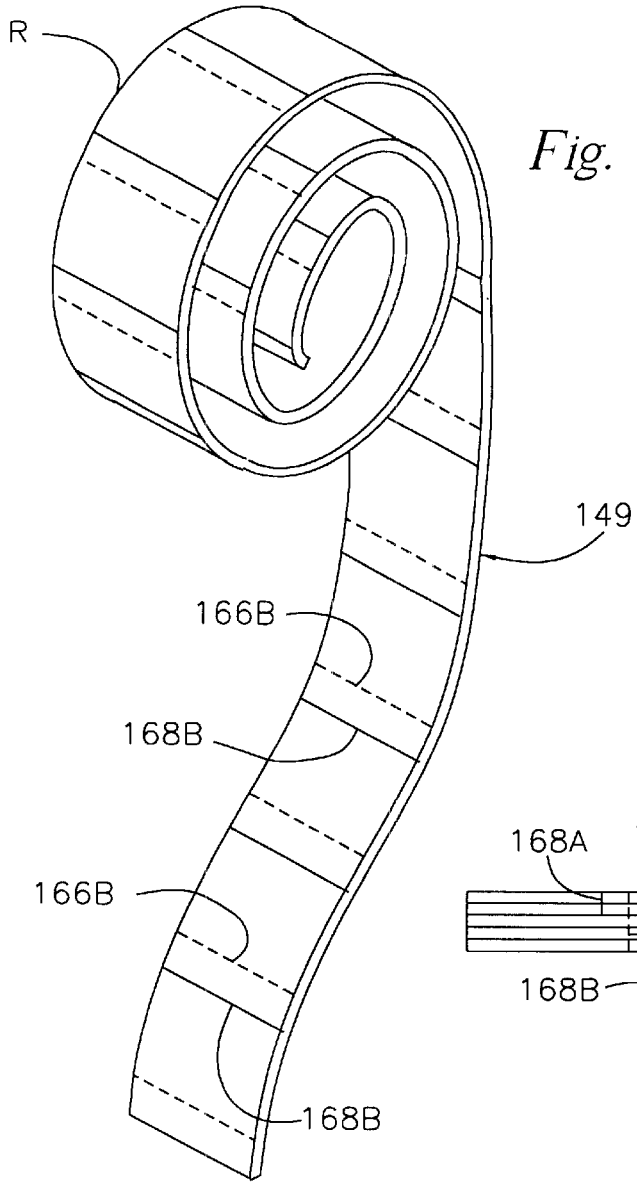
FIG. 18 is a partially perspective and partially plan view of similar multi-layer material provided in strip form.
Figure 17:
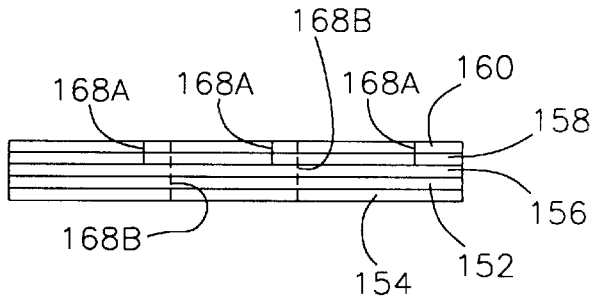
FIG. 17 is a schematic end view of the sheet assembly of FIG. 16.

The release liners 40,40A,140 may be supplied to users in flexible sheet or strip form, such as in rolls, for on-site application to merchandise supports by the users. Examples of such products are illustrated in FIGS. 14-18. FIGS. 14 and 15 illustrate multi-layer sheet stock 148 which is scored to provide a plurality of liner assemblies 150 for forming strip liners such as the liners 40A of FIGS. 3. FIGS. 16 and 17 illustrate similar sheet stock 148A scored for forming liners such as the individual label liners 40. FIG. 18 illustrates similar sheet stock 149 in strip form, that may be supplied in rolls, and scored for forming release liners of any predetermined length, e.g., for forming liners 40 or 40A. Each such liner assembly 148,148A,150 includes a carrier body layer 152, a release layer 154, an adhesive layer 156, a second release layer 158 and a second carrier body 160. The body layer 152 is of the same material as body layers 42 and 142 described above. The release layer 154 is of the same materials as the release layers 44 and 144 described above. The adhesive layer 156 is of the same materials as the layers 46 and 146 described above. The second carrier body layer 160 may be of the same material as the carrier body layer 152 or of a different material and carries the second release layer 158 firmly bonded thereto to form a protective cover layer 162 for the adhesive layer 156. The second release layer 158 is similar to the release layer 154 but may have a lesser release value whereby the protective cover layer 162 is readily removable to expose the adhesive 156.

The entire assembly 150 of FIGS. 14 and 15 preferably is provided with transverse scores as at 166 at appropriate spacings to define individual strips for forming liners such as liners 40A by tearing or cutting along the scores. Additional cuts or tab edges may be provided through the cover layer, as at 168, to facilitate removal of each corresponding cover segment when the respective liner segment is to be applied to a support. The assembly 148A of FIGS. 16 and 17 is similarly scored along transverse lines 166A and longitudinal lines 166B to define shorter segments 150A for forming release liners 40. The assembly 148 includes multiple cut lines 168A through the cover layer 162 to provide cuts or tabs for removing this layer from the individual liner segments.

The stock assembly 149 of FIG. 18 provides similar liner assemblies in a narrow strip form of a width corresponding to the desired liner width and of indeterminate length. The multi-layer strip 149 preferably is supplied in rolls R as illustrated. The assembly is provided with transverse scores 166B therethrough at predetermined spacings corresponding to the desired lengths of individual liner strip segments. Transverse cuts or tabs also may be provided in the cover layer, as at 168B, for convenient removal of the respective cover layer segments. The strip 149 should be maintained in lateral alignment in the roll during use, to prevent "telescoping" of the coils along the axis of the roll. This may require lateral constraints, such as by placing the roll R in a dispensing container of appropriate width or providing the roll on a flanged spool. In the roll form, the cover layer 162 also may be omitted. The coiling places the outer surface of the release layer 154 of each coil adjacent the adhesive layer 156 of an adjacent coil. Therefore the release layer 154 may be relied upon for providing suitable protection for the adhesive 156 in the roll R while adhering thereto adequately for maintaining the roll coils in lateral alignment during use and providing easy parting as the roll is uncoiled.

From the foregoing it can be seen that display supports have been provided which accomplish the aforenoted objects of this invention.

It will be understood that other variations, modifications and substitutions of equivalent configurations can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. A merchandising shelf defining an upwardly disposed surface for receipt of merchandise thereon and having an outer edge which is exposed outwardly relative to a structural support on which such a shelf is supported when in use, said shelf having a label supporting surface along said outer edge, a label attachment element adhered to said label supporting surface and having an outwardly exposed mounting surface, and said label attachment element including an outwardly exposed release layer which has a release value for adhesively coated labels that is substantially less than the release value of said label supporting surface for such labels and will adherently receive and retain an adhesively coated label in overlying relation to said release layer for supporting and displaying an adhesively coated product information label and readily release such a label, whereby such labels applied to said release layer are exposed outwardly relative to said support and are readily appliable, removable and replaceable by merchandising personnel.

2. A merchandising shelf as in claim 1 in combination with a supply of multiple separate pressure sensitive adhesive labels, wherein said release layer provides a release value of less than about two pounds for said pressure sensitive adhesive labels when adhered thereto.

3. A merchandising shelf as in claim 1 in combination with a supply of multiple separate pressure sensitive adhesive labels, wherein said release layer provides a release value of between about 20 grams and about 160 grams for said pressure sensitive adhesive labels when adhered thereto.

4. A merchandising shelf as in claim 1 in combination with multiple labels having pressure sensitive adhesive on one side for adherent attachment of each such label to said release layer on said shelf and thereafter being readily removable therefrom.

5. The combination as in claim 4 wherein each of said labels is a paper label and said adhesive thereon is either a rubber-based or acrylic pressure sensitive adhesive.

6. The combination as in claim 5 wherein said release layer provides a release value of less than about one pound with said adhesive of said labels.

7. The combination as in claim 5 wherein said release layer provides a release value of between about 20 grams and about 160 grams with said adhesive of said labels.

8. A merchandising shelf as in claim 1, wherein said release layer is a coating of a silicone material.

9. A merchandising shelf as in claim 1 wherein said label attachment element is a release coating that is bonded directly to said label supporting surface.

10. A merchandising shelf defining an upwardly disposed surface for receipt of merchandise thereon and having an outer edge which is exposed outwardly relative to a structural support on which such a shelf is supported when in use, said shelf having a label supporting surface extending substantially the full length of said shelf along said outer edge, a label attachment element extending over substantially the full length of said label supporting surface and adhered to said label supporting surface, said label attachment element having an outwardly exposed mounting surface along substantially its entire length, and said label attachment element including an outwardly exposed release layer over its length which has a release value for adhesively coated labels that is substantially less than the release value of said label supporting surface for such labels and which will adherently receive and retain such labels in overlying relation to said release layer for supporting and displaying adhesively coated product information labels in any location along said mounting surface and readily release each such label, whereby such labels applied to said release layer are exposed outwardly relative to said support and are readily appliable, removable and replaceable by merchandising personnel in any location along the length of said shelf.

11. A merchandising shelf defining an upwardly disposed surface for receipt of merchandise thereon and having an outer edge which is exposed outwardly relative to a structural support on which such a shelf is supported when in use, said shelf having a label supporting surface extending substantially the full length of said shelf along said outer edge, a label attachment element extending over substantially the full length of said label supporting surface and affixed over said label supporting surface, said label attachment element having an outwardly exposed mounting surface along substantially its entire length, and said label attachment element including an outwardly exposed release layer over its length which has a release value for adhesively coated labels that is substantially less than the release value of said label supporting surface for such labels and which will adherently receive and retain an adhesively coated label in overlying relation to said release layer for supporting and displaying adhesively coated product information labels in any location along said mounting surface and readily release each such label, whereby such labels applied to said release layer are exposed outwardly relative to said support and are readily appliable, removable and replaceable by merchandising personnel in any location along the length of said shelf.

12. A merchandising shelf as in claim 11 wherein said label attachment element is a support member that includes label engagement elements for engaging and supporting a label carrier member adjacent said label supporting surface with one side of such label carrier member disposed outwardly, and a label carrier member, said label carrier member including a carrier layer of a size and configuration to engage within said label engagement elements for retention thereby on said support member with one surface of said label carrier member disposed outwardly relative to said arm, said release layer being on said outward surface of said label carrier member.

13. A merchandising shelf as in claim 12 wherein said label engagement elements comprise lips which extend generally horizontally along upper and lower edges of said support member for engaging upper and lower edges of such a label carrier member.

14. A merchandising shelf as in claim 11 wherein said label attachment element comprises a label carrier member, said label carrier member including a carrier layer, an adhesive layer on one side of said carrier layer for adhesively affixing said label carrier member to said label supporting surface of said support with the opposite side of said carrier layer disposed outwardly relative to said support, and said release layer being on said opposite side of said carrier.

15. A merchandising shelf as in claim 11 wherein said label attachment element is a release coating that is bonded directly to said label supporting surface.

16. A method of maintaining current merchandising labels in association with merchandise being marketed, the merchandise being carried on a merchandise display support, and the merchandise display support having associated therewith a merchandise label supporting surface, the method comprising the steps of:

applying over the merchandise label supporting surface a release element which is affixed to the merchandise label support and has an exterior surface providing a label release surface, the label release surface having a characteristic release value for adhesive labels which is substantially less than the release value of said supporting surface and which causes adhesive labels to adhere thereto, when said labels are applied, but which allows such adhesive labels to be peeled cleanly from the label release surface without substantial tearing or delamination of the labels;

applying an adhesive label bearing current merchandising information to said label release surface for characterizing the merchandise carried on the merchandise display support;

when the merchandise or the merchandise characteristics change, peeling said adhesive label from said label release surface and applying a new adhesive label thereto bearing updated merchandising information; and repeating said last mentioned step each time the merchandising information changes using a plurality of successive updated adhesive labels which are similarly released, when needed, by said label release surface.

17. A method as in claim 16, including the step of mounting said merchandise display support in a generally horizontal position for holding products thereon and with said label supporting surface thereof disposed outwardly for viewing by passing customers for the merchandise thereon, and thereafter affixing said release element to said label supporting surface.

18. A method as in claim 16, wherein said release surface provides a bond strength to said adhesive labels which is less than the strength of attachment of said release surface to said label supporting surface and less than the tear strength of said labels.

19. A method as in claim 18 wherein each of said labels is a paper label with either a rubber-based or acrylic pressure sensitive attachment adhesive thereon.

20. A method as in claim 19 including providing a release value of less than about two pounds for peeling of said adhesive labels from said release surface.

21. A method as in claim 19 including providing a release value of between about 20 grams and about 160 grams for peeling of said adhesive labels from said release surface.

22. A method as in claim 19 including providing a release value of less than about one pound for pressure sensitive adhesive labels adhered to said release surface.

23. A method as in claim 16 including providing a release value of between about 20 grams and about 160 grams for peeling of such adhesive labels adhered to said release surface.

24. A method as in claim 16 including providing a label release liner having an adhesive on one side thereof and a label release layer on an opposite side thereof which provides said release surface, and adhering said label release liner to said label support surface with said label release surface exposed outwardly for releasably retaining said labels thereon.

25. A method as in claim 24 wherein said label release layer is a coating of a silicone material.

26. A method as in claim 16 including applying a coating of a label release material to said label support surface to form said release element and provide said release surface.

27. A method as in claim 21 wherein said coating is a silicone material.

28. A method as in claim 16 wherein said merchandise display support is a merchandise support shelf having said label supporting surface along one edge surface thereof.

29. A method of maintaining current merchandising paper labels in association with merchandise to be marketed, the merchandise being carried on a merchandise display support, and the merchandise display support having associated therewith a merchandise label supporting surface, the method comprising the steps of:

applying over the merchandise label supporting surface a release element which is affixed to the merchandise label support and has an exterior surface providing a label release surface, the label release surface having a characteristic release value for adhesive labels which is substantially less than the release value of said supporting surface and which causes adhesive paper labels to adhere thereto, when said labels are applied, but which allows such adhesive paper labels to be peeled cleanly from the label release surface;

applying an adhesive paper label bearing current merchandising information to said label release surface for characterizing the merchandise carried on the merchandise display support;

when the merchandise or the merchandise characteristics change, peeling said paper label from said label release surface and applying a new adhesive paper label thereto bearing updated merchandising information; and repeating said last mentioned step each time the merchandising information changes using a plurality of successive updated paper adhesive labels which are similarly released, when needed, by said label release surface.

30. A combination comprising a merchandising shelf which has an upwardly exposed surface for receipt of merchandise thereon and an outer edge surface which is exposed outwardly relative to a structural support on which such a shelf is supported when in use;

a release liner of a width and length substantially corresponding to the width and length of said outer edge surface for supporting and displaying adhesively coated product information labels on said outer edge surface of said shelf; and means for affixing said release liner to said shelf over said outer edge surface to substantially cover said outer edge surface of said shelf;

said release liner comprising:

a carrier body which has an inner side to be disposed toward said shelf and an outer side to be disposed outwardly relative to said shelf when said release liner is so affixed over said outer edge surface by said means, and a release layer on said outer side of said carrier body and which has a release value for adhesively coated labels that is substantially less than the release value of said outer edge surface for such labels and will adherently receive and retain an adhesively coated label in overlying relation to said release layer and readily release such a label, whereby such labels applied to said release layer while said release liner is so affixed to said shelf are exposed outwardly relative to said shelf and are readily appliable, removable and replaceable by merchandising personnel.

31. A combination as in claim 30 and including a supply of multiple separate pressure sensitive adhesive labels, wherein said release layer provides a release value of less than about one pound for said pressure sensitive adhesive labels when adhered thereto.

32. A combination as in claim 30 and including a supply of multiple separate pressure sensitive adhesive labels, wherein said release layer provides a release value of less than about one pound for said pressure sensitive adhesive labels when adhered thereto.

33. A combination as in claim 30 and including a supply of multiple separate pressure sensitive adhesive labels, wherein said release layer provides a release value of between about 20 grams and about 160 grams for said pressure sensitive adhesive labels when adhered thereto.

34. A combination as in claim 30 wherein said release layer is a coating of a silicone material.

35. A combination as in claim 30 wherein said means is an adhesive layer on said inner side of said carrier body.

36. A Combination as in claim 30 wherein said means includes engagement elements on said shelf for engaging and supporting said release liner.

37. A Combination as in claim 30 wherein said means includes engagement elements on said shelf for engaging said release liner and supporting said liner with said inner side adjacent said outer edge surface.

* * * * *

UNITED STATES PATENT AND TRADEMARK OFFICE

CERTIFICATE OF CORRECTION

PATENT NO. : 6,385,885 B1
DATED : May 14, 2002
INVENTOR(S) : Thomas E. Valiulis

It is certified that error appears in the above-identified patent and that said Letters Patent is hereby corrected as shown below:

Column 12,
Line 43, change "one pound" to read -- two pounds --

Signed and Sealed this

Twenty-ninth Day of October, 2002

*Attest:*

*Attesting Officer*

JAMES E. ROGAN
*Director of the United States Patent and Trademark Office*